United States Patent [19]

Bradley et al.

[11] 4,349,105

[45] Sep. 14, 1982

[54] GUN CARTON

[75] Inventors: Michael F. Bradley, Feeding Hills; Jack C. Viecelli, Agawam, both of Mass.

[73] Assignee: Longview Fibre Company, West Springfield, Mass.

[21] Appl. No.: 257,813

[22] Filed: Apr. 27, 1981

[51] Int. Cl.[3] ..... B65D 5/48; B65D 5/50

[52] U.S. Cl. ..... 206/317; 206/45.14; 220/416; 229/27

[58] Field of Search ..... 206/44.11, 45.14, 45.19, 206/317, 491, 521; 229/16 R, 16 D, 27, 29 D, 44 R

[56] References Cited

U.S. PATENT DOCUMENTS

| | | | |
|---|---|---|---|
| 3,156,351 | 11/1964 | Small | 206/317 |
| 3,669,336 | 6/1972 | Robinson | 206/317 |
| 3,896,987 | 7/1975 | Soja | 206/317 |
| 3,907,108 | 9/1975 | Weimer | 206/317 |

*Primary Examiner*—William Price
*Assistant Examiner*—Brenda J. Ehrhardt
*Attorney, Agent, or Firm*—Chapin, Neal & Dempsey

[57] ABSTRACT

A carton for shipping and displaying a shotgun is disclosed. The carton is formed from a unitary blank of horizontally-extending, stock cover panels each having a hingedly-attached, vertically foldable panel which together divide the carton into separate front and rear compartments, one for snugly packaging the stock portion and the other receiving the barrel portion of the shotgun which are packaged as separate items. A V-shaped carton portion is foldably attached to one of the vertically foldable panels and is adapted to fit over the barrel and hold it stationary within the carton. An angular flap extends from one of the stock corner panels and is disposed to protect the edge of the V-shaped carton portions at one end thereof against damage by a barrel ring disposed in contact therewith. In addition, a multi-paneled pocket flap is attached to one of the vertical panels and is foldable against both that panel and a front upright wall of the carton to provide a pocket in one of the carton compartments for housing the choke components of the shotgun.

9 Claims, 6 Drawing Figures

GUN CARTON

BACKGROUND OF THE INVENTION

This invention relates to fiberboard carton for shipping and displaying firearms and, in particular, shotguns with the barrel and stock portion separated.

In the prior art, various cartons have been used to transport firearms in either an assembled or disassembled state. When broken down, the stock and barrel may be housed in separate carton chambers in a compact packaging arrangement. The barrel, being relatively heavy, tends to move laterally during transit and unless securely restrained may cause damage to the ends of the carton and may even break through the carton after rough handling. To avoid such damage, various fillers or inserts have been placed in the carton to prevent movement of the barrel.

Some recent patents, such as U.S. Pat. Nos. 3,156,351 to Small and 3,907,108 to Weimer, have each disclosed a unitary, one-piece carton blank which folds to produce a carton with a series of vertical and horizontal panels to hold separate pieces of a disassembled weapon in a fixed position. The present invention is an improvement upon these types of cartons.

Accordingly, it is a principal object of the present invention to provide a unitary fiberboard carton construction which is convenient to use for shipping and retail distribution of shotguns and which securely holds the shotgun during shipments.

It is another object to provide a shipping carton which can be used for attractive retail display of the firearm.

It is another object to provide a display carton which permits a weapon to be removed for inspection and subsequently repackaged without damage to the carton.

It is another object to provide and display a carton, commensurate with the above-listed objects with locking tabs that permit the cover of the display carton to be securely closed and quicky locked in place so that a buyer can conveniently transport the gun in the display carton.

The above and other objects and advantages of this invention will become more readily apparent when the following description is taken in conjunction with the accompanying drawings.

DESCRIPTION OF THE PREFERRED EMBODIMENT

Figure 1:
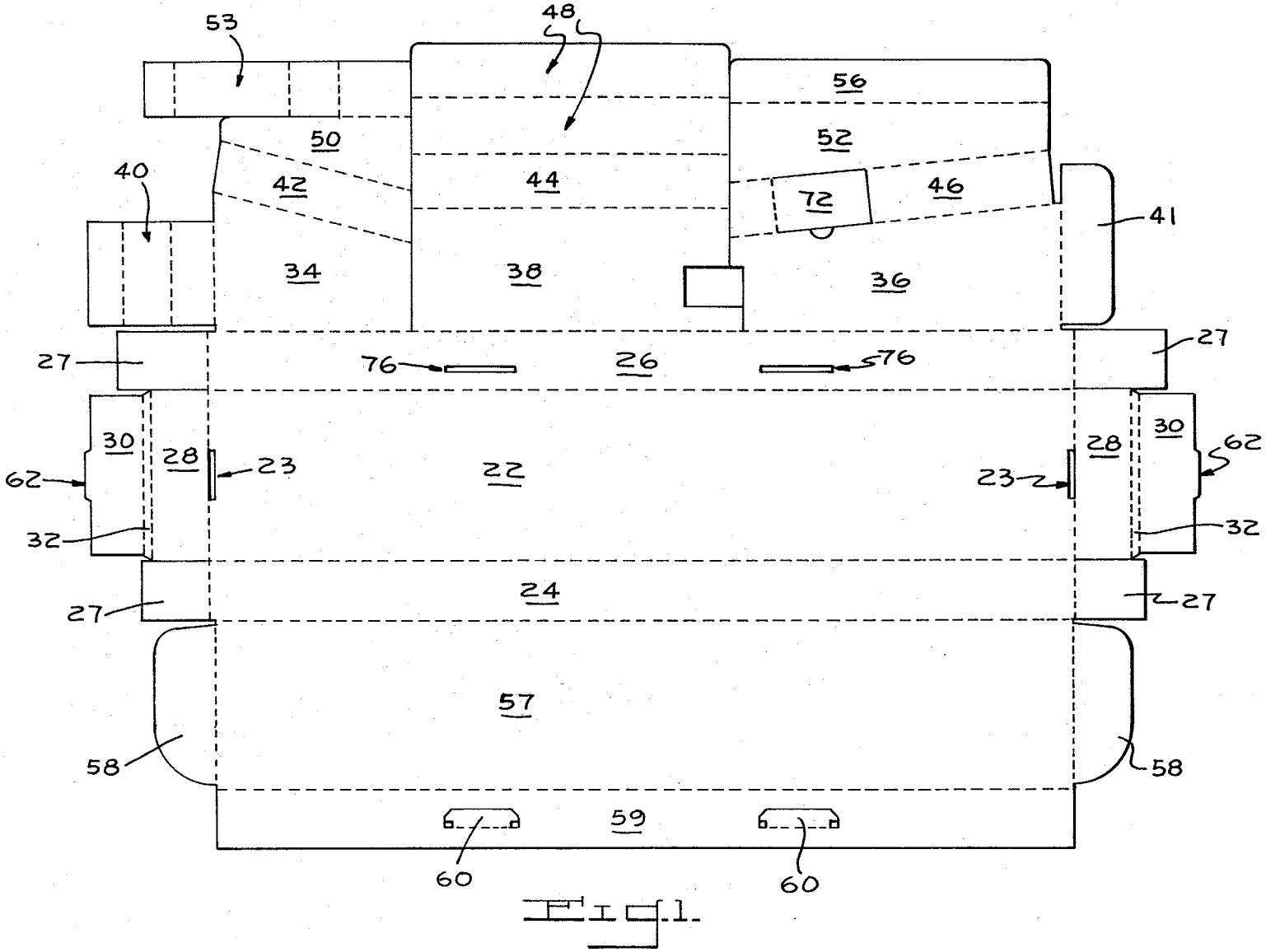
FIG. 1 is a plan view of a unitary, pre-scored fiberboard blank used to form a gun carton in accordance with the present invention.

Referring to the drawings in detail, a fiberboard carton 10 is specifically designed for shipping and displaying a disassembled shotgun 12. The carton (FIG. 5) includes separate front and rear compartments 14, 16 for housing the disassembled barrel portion 18 and stock portion 20 of the weapon.

As shown in FIG. 1, a creased or pre-scored blank from which the carton 10 is formed contains a rectangular bottom panel 22 having a cut-out or slot 23 at each of its edges. Foldably attached to the longer side edges of panel 22 are rectangular front and rear walls 24 and 26, respectively.

At each end of the bottom panel 22 is a multi-paneled end wall unit comprising an outer end wall 28 attached to the end edges of the bottom panel 22 and an inner end wall 30 foldably attached to outer end wall 28 through a narrow intermediate shoulder panel 32.

The compartment 14 for receiving the gun stock 20 is formed by a portion of bottom panel 22, rear panel 26, and three multi-segmented stock cover sections which extend from rear wall 26. End cover sections comprise first and second trapezoidal portions 34, 36, and central cover section includes a rectangular panel 38. As best shown in FIG. 1, a three-section, butt-end cushioning flap 40 (for protecting the butt of stock 20) extends from the outer edge of the first trapezoidal cover panel 34 and a side locking panel 41 is connected to the second trapezoid panel 36. The compartment 14 further includes three vertical connector walls 42, 44, 46 that are hingedly joined to the cover portions 34, 36 and 38, respectively.

Attached to a longitudinal edge of connector wall 44 is a multi-paneled flap or hold-down panel 48 which forms a portion of the compartment 16 for housing the gun barrel 18.

Foldably attached to the vertical connector walls 42, 46 are a pair of trapezoidal panels 50, 52 which reinforce the bottom of the carton and cushion the barrel 18 in compartment 16. In the preferred embodiment, a four-section pocket flap 53 is joined to the panel 50 and forms a sub-compartment or pocket 54 for housing choke components 55 of the shotgun 12. A vertical cushioning flap 56 is joined to the panel 52 for bracing the barrel 18 during transit.

A carton closure or cover panel 57 hingedly extending from the upper edge of front wall 24 includes end flaps 58 at each end thereof and a foldable flap 59 along its outer edge. The flap 59 has a pair of undercut locking tabs 60 to fasten the cover securely in its closed position by fitting the tabs into slots 76 correspondingly disposed in panel 26.

The carton is prepared for loading by folding the front and rear walls 24, 26 upwardly into an upright position and then folding panels 27 perpendicular to walls 24, 26. The outer end panels 28 and 30 are reversibly folded over the panels 27 which are thus sandwiched between panels 28 and 30 to form three-ply end walls on the carton. A short tongue 62 on the outer edge of panels 30 is inserted into the bottom panel cut-out 23 to lock the upright walls of the carton into the condition shown in FIG. 2.

Figures 2, 3:
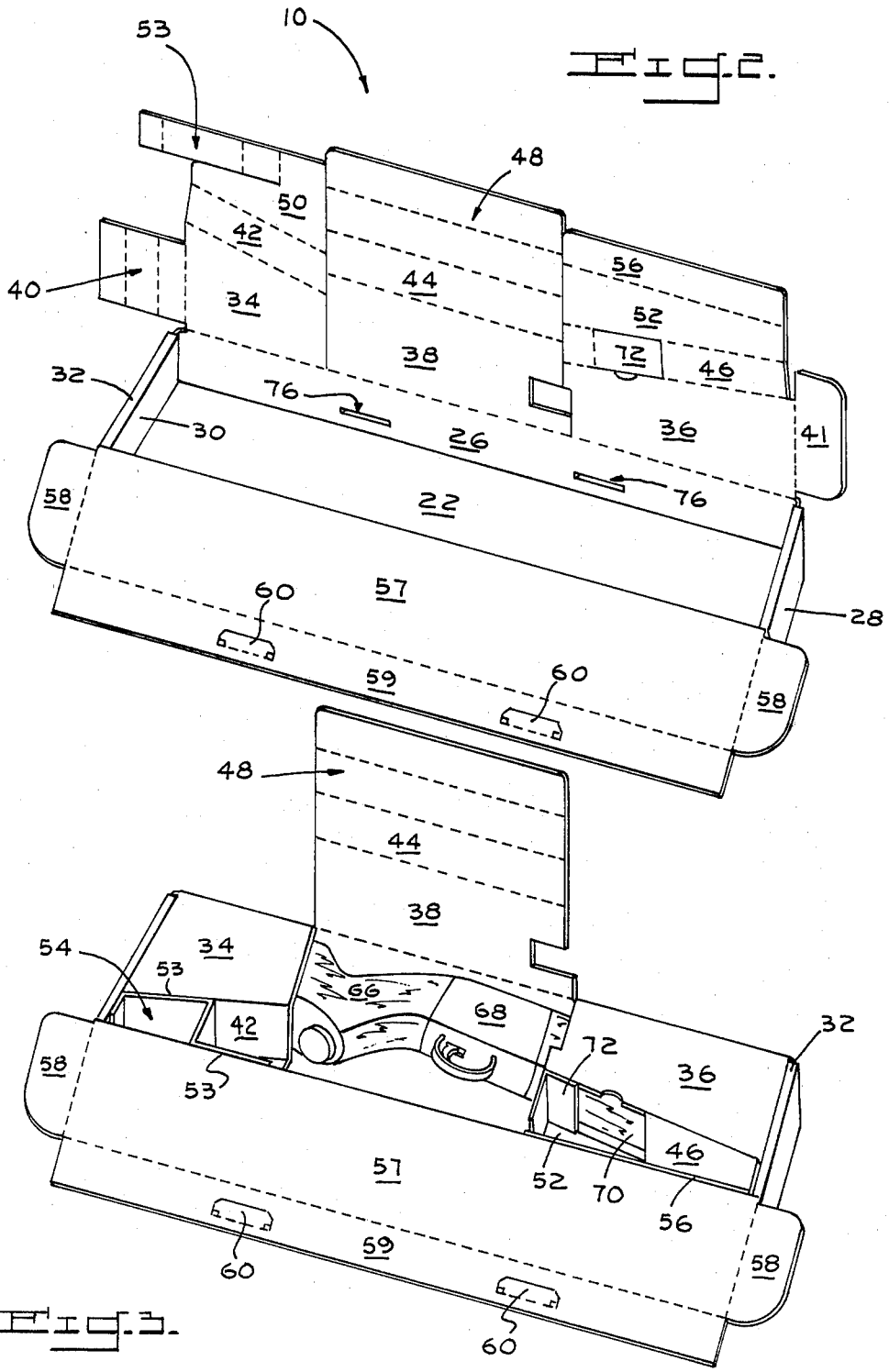
FIG. 2 is a perspective view of the blank of FIG. 1 assembled to form a carton ready to receive the stock of a disassembled shotgun.
FIG. 3 is a perspective view of a stock housed in the carton of FIG. 2, with additional panels of the blank folded to house the stock.
Figure 6:
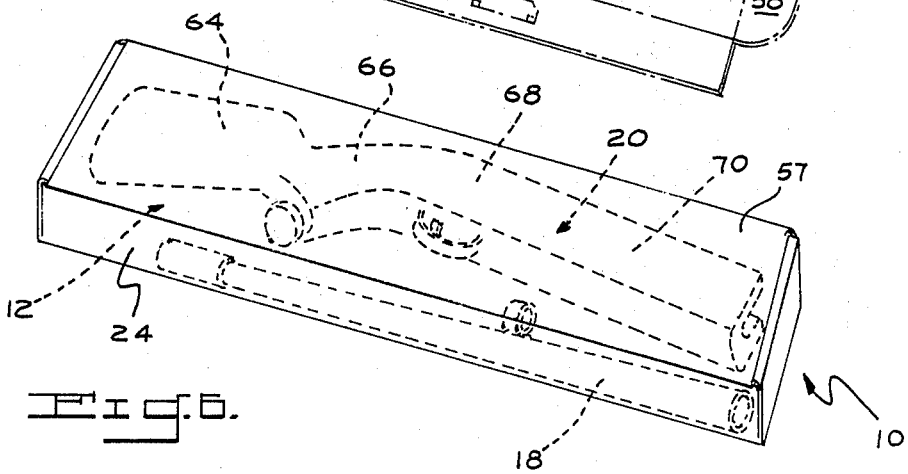
FIG. 6 is a perspective view of the FIG. 5 carton with its top cover in closed condition.

The carton 10 is now ready to receive the stock portion 20 of a shotgun which, as shown in FIGS. 3 and 6, consists of a butt 64, a pistol grip 66, a receiver 68 with a trigger housing and a bolt housing, and a fore-stock 70. The stock portion 20 is placed in the carton with its top surface against the rear wall 26 of the carton (FIG. 3). The stock 20 occupies substantially the entire length of the carton so that it is restrained from moving longitudinally in the carton.

After the stock has been placed in the open carton, stock cover panels 34 and 36 are folded over the stock, as shown in FIG. 3. Before the panel 34 is folded over the stock, the segmented cushioning flap 40 is folded upon itself so that it can be inserted between the butt 64 and the left-hand end wall 30 to cushion the butt during transit (see FIG. 4). The panels 42, 46 are then folded downwardly so as to form vertical walls dividing one carton into two lengthwise compartments, the rear compartment for the stock and the front compartment for the barrel.

As shown in FIG. 3, the trapezoidal panels 50, 52 are swung perpendicular to the vertical walls 42, 46 so that the panels 50, 52 are disposed against the bottom panel 22 to reinforce the same. They also engage an upright front wall of the carton to thereby firmly retain the rear compartment of the carton in its erect condition. The four-section pocket flap 53 is folded like a question mark as shown in FIG. 3 and disposed atop the panel 50 so as to form the chamber or pocket 54. Further, the vertical flap 56 is folded upwardly parallel to and against front wall 24 to reinforce the same.

Figure 5:
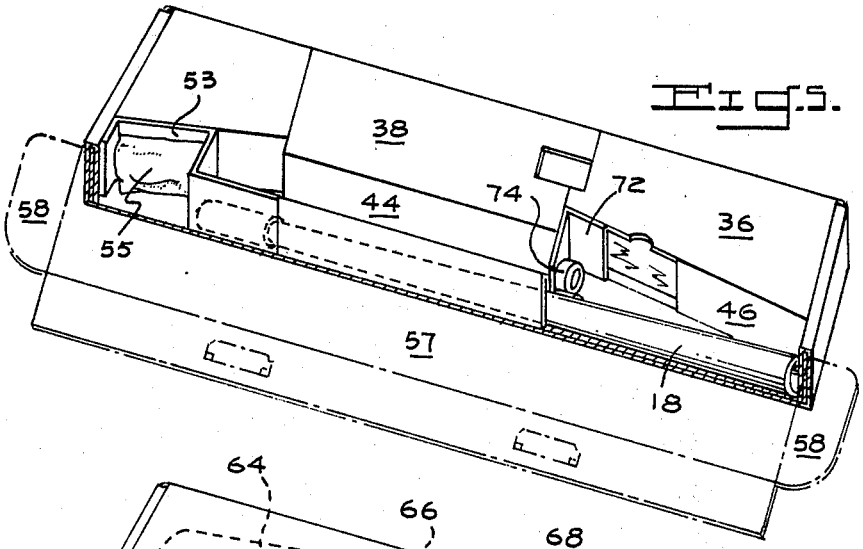
FIG. 5 is a perspective view similar to FIG. 4, but with a barrel housed in the carton.

To complete the assembly shown in FIG. 3, an angular L-shaped reinforcing panel 72 is provided for preventing the barrel ring 74 cutting into or breaking down the vertical edge of panels 44 and 48, as best seen in FIG. 5.

Figure 4:
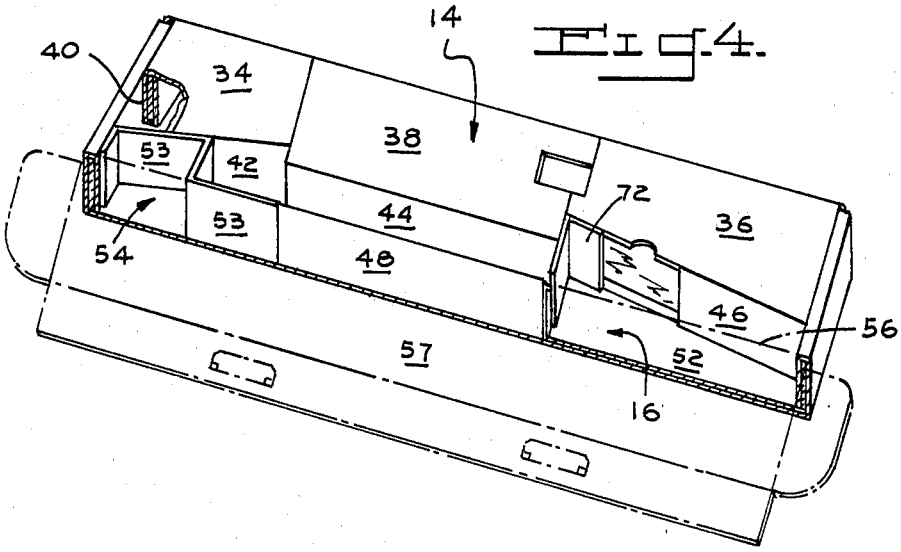
FIG. 4 is a perspective view similar to FIG. 3 with other panels folded to enclose the stock and provide another carton section for the gun barrel.

Turning to FIG. 4, the stock compartment 14 is completed by folding the intermediate stock cover panel 38 inwardly over the piston grip 66 and receiver 68 portions of the stock and folding wall 44 perpendicular to the bottom panel 22 whereby it abuts the undersurface of the stock. The hold-down panels 48 are folded into a V-shape barrel retainer along the front compartment 16 of the carton.

The stock cover panel 38 and the hold-down panels 48 may be lifted to insert a barrel 18 into the carton 10. The panels 38 and 48 are then fitted into their positions shown in FIG. 5. Of course, the barrel can be placed in the carton before the hold-down panels 48 are initially folded as shown in FIG. 4.

As shown in FIG. 5, one end of the barrel is disposed flush against the right-hand wall 30 and the barrel ring 74 is placed flush against the L-shaped panel 72 which is held in fixed position by vertical panel 44. The barrel is thus restrained from lateral movement in either direction. Further, hold-down panels 48 which are wedged against opposite sides over a substantial length of the barrel effectively prevent any angular shifting of the barrel during carton handling.

It can now be appreciated that the stock and barrel are held stationary even during handling of the carton. Consequently, damage to the carton caused by shifting of either the stock or barrel is essentially eliminated.

Though vertical cushioning panel 56 has been removed from FIG. 5 for the sake of clarity, it should be understood that flap 56 (see FIGS. 2–4) and portions of hold-down panel 48 and pocket flap 53 are located between the barrel 18 and front wall 24. These form a protective, reinforcing wall along the entire length of barrel 18 and combine with front wall 24 to provide double wall protection for the barrel during transit.

To fully close the carton, the side locking flaps 58 at each end of top cover panel 57 are folded inwardly until they are substantially at right angles to panel 57. Panel 57 is then folded inwardly and against the stock cover panels 34, 36, 38 with the locking flaps 58 being inserted between the panels 34, 36 and the inner end walls 30. To complete the closing, rear flap 59 is folded inwardly until the flap is substantially perpendicular to the top cover panel and closely adjacent to the rear wall 26.

The cover 57 can either be stapled closed and/or locked into its closed position of FIG. 6 by fitting the tabs 60 into a pair of slots 76 in the rear wall 26.

As will be apparent to those skilled in the art, the carton 10 can be opened to display the firearm 12 on a store shelf and thereafter closed to safely transport the weapon after its purchase. Of course, if the cover is stapled closed by the manufacturer, the staples can be removed for retail display of the firearms. After a sale, it may be locked closed by simply using the locking tabs 60. The carton can be displayed on a store shelf in either its FIG. 5 position or a slight variant thereof, e.g., with the central panel 38 and hold-down panel 48 raised to expose the barrel 18 and portions of stock 20. After the gun has been removed from the carton and inspected by a prospective buyer, the gun can be easily repackaged.

To further protect the barrel 18 and stock 20, protective padding or fillers can, of course, be used, although, due to the highly protective nature of carton 10, these additional precautions are not normally needed.

It should be understood that obvious structural modifications can be made without departing from the scope of the invention. Accordingly, reference should be made primarily to the accompanying claims, rather than to the specification, to determine the scope of the invention.

Having thus described the invention, what is claimed is:

1. A carton for housing the stock portion and barrel portion of a disassembled firearm in separate compartments, the carton comprising:

(a) a bottom panel with hinged end walls and a front and rear wall extending therefrom;

(b) stock cover panels for overlying the stock, said cover panels each having a first edge attached to the rear wall and an opposed second edge;

(c) a vertically foldable panel attached to the second edge of each stock cover panel for longitudinally dividing the carton into front and rear compartments, one compartment for housing the stock and the other for housing the barrel; and (d) means for holding a barrel in said carton, said means including a substantially V-shaped portion extending from the lower edge of one of said vertical panels and adapted to retain the barrel in stationary relation within said carton.

2. The carton of claim 1 wherein said carton further comprises:

(a) a top cover panel attached to the front wall, said top cover extending substantially the entire length of the carton;

(b) said top cover having a flap that is foldable against the rear wall; and (c) means to lock the top cover in a closed position and thereby hold the carton compartments, the barrel, and the stock in fixed positions, said locking means including a plurality of undercut tabs in the foldable flap that are insertable in associated slots in the rear wall.

3. The carton of claim 1 wherein a plurality of cushion panels are hinged to said vertical panels and are foldable parallel to and against said bottom panel for providing a bottom cushion for said barrel.

4. The carton of claim 3 wherein each of said bottom cushion panels has an attached panel that is vertically foldable parallel to and against the front wall to provide a cushion between the front wall and the barrel.

5. The carton of claim 4 wherein the vertical cushioning panels and the V-shaped portion extend along substantially the entire length of the barrel to provide a multi-section reinforcing wall between said barrel and said front wall.

6. The carton of claim 5 further comprising a multipiece firearm comprising a stock portion and a barrel portion, the stock being housed in the front compartment under said stock panels, and the barrel being housed in said rear compartment.

7. The carton of claim 6 wherein the barrel has one end flush against one of the end walls of said carton and said barrel has a projection which abuts an end of said V-shaped portion to prevent lateral movement of said barrel during handling of the carton.

8. The carton of claim 7 wherein one of said vertical panels has an undercut, scored panel that is foldable against an edge of an adjacent vertical panel to prevent said barrel projection from breaking down said edge during handling of the carton.

9. The carton of claim 3 wherein a multi-panel pocket flap is foldably attached to one of said bottom cushion panels and is adapted to subdivide one of the compartments into a pocket for housing choke components of the firearm.

* * * * *